US006571971B1

(12) United States Patent
Weiler

(10) Patent No.: US 6,571,971 B1
(45) Date of Patent: Jun. 3, 2003

(54) HERMETICALLY SEALED CONTAINER WITH PIERCEABLE ENTRY PORT

(75) Inventor: Gerhard H. Weiler, Woodstock, IL (US)

(73) Assignee: Weller Engineering, Inc., Elgin, IL (US)

( * ) Notice: Subject to any disclaimer, the term of this patent is extended or adjusted under 35 U.S.C. 154(b) by 0 days.

(21) Appl. No.: 09/779,767

(22) Filed: Feb. 8, 2001

(51) Int. Cl.[7] ..... A61B 19/00; B65D 17/42

(52) U.S. Cl. ..... 215/247; 215/DIG. 3; 604/411; 604/415

(58) Field of Search ..... 141/329, 327; 215/DIG. 3, 247, 249, 327; 604/403, 405, 407, 411, 412, 413, 414, 415, 416

(56) References Cited

U.S. PATENT DOCUMENTS 2,577,780 A * 12/1951 Lockhard ..... 215/247 X
3,870,183 A * 3/1975 Luczkiw ..... 215/247
4,526,279 A 7/1985 Weiler et al.
4,869,384 A * 9/1989 Ogle, II ..... 215/247
5,060,812 A * 10/1991 Ogle, II ..... 215/247
5,114,030 A * 5/1992 Conard ..... 215/249
5,232,109 A * 8/1993 Tirrell et al. ..... 215/247
5,297,599 A * 3/1994 Bucheli ..... 215/247 X
5,395,365 A 3/1995 Weiler et al.
5,433,330 A * 7/1995 Yatsko et al. ..... 215/247
5,462,200 A 10/1995 Weiler
5,464,111 A * 11/1995 Vacek et al. ..... 215/249
5,595,314 A 1/1997 Weiler
5,711,453 A 1/1998 Weiler
5,718,346 A 2/1998 Weiler
5,817,082 A * 10/1998 Niedospial, Jr. et al. .... 215/247

* cited by examiner

*Primary Examiner*—Tri M. Mai
(74) *Attorney, Agent, or Firm*—Olson & Hierl, Ltd.

(57) ABSTRACT

A closure insert for a hermetically sealed container including a hollow boss that defines an access port sealed by a pierceable membrane and by a primary seal in the form of an inwardly extending skirt portion that sealingly surrounds a draining spike after piercing the membrane.

10 Claims, 2 Drawing Sheets

FIG. 1
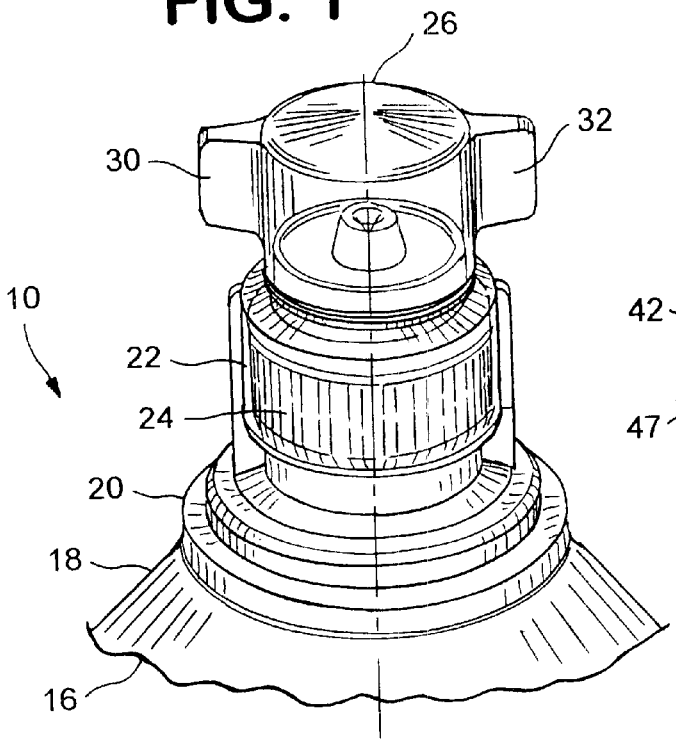
FIG. 3
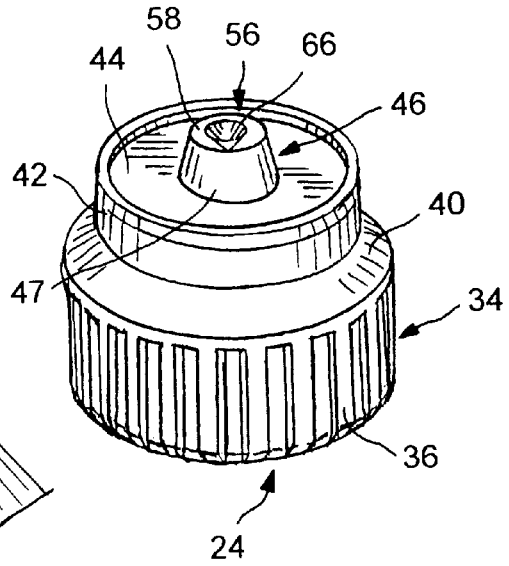
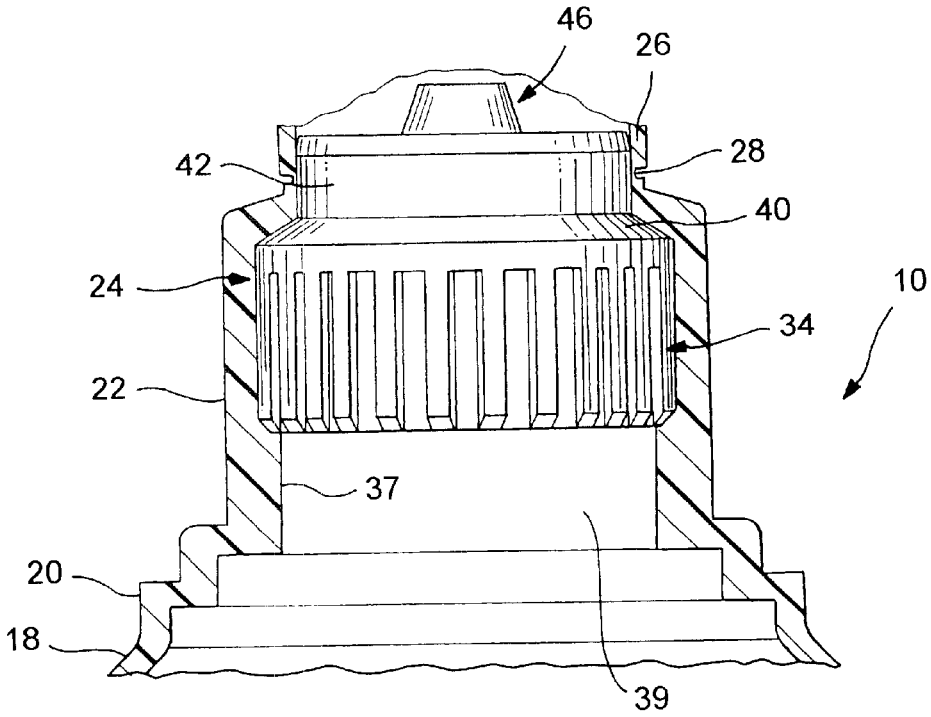
FIG. 2

HERMETICALLY SEALED CONTAINER WITH PIERCEABLE ENTRY PORT

FIELD OF THE INVENTION

This invention relates to a hermetically sealed container and, more particularly, to a hermetically sealed container provided with an access port sealed by a pierceable membrane and with a pair of sealing surfaces for a draining spike within the container.

BACKGROUND OF THE INVENTION

This invention is directed to the type of hermetically sealed containers generally disclosed in U.S. Pat. No. 6,076,704 to Weiler et al. and U.S. Pat. No. 6,092,682 to Weiler which incorporate pierceable membranes which seal the container contents and are adapted to be pierced by a draining spike so as to allow the contents to be dispensed or drained from the container.

In particular, the container disclosed in U.S. Pat. No. 6,076,704 to Weiler et al. includes a neck defining an opening sealed by a pierceable membrane adapted to be pierced by a separate draining spike so as to allow the drainage of the container contents through the dispensing nozzle of a cap which is secured over the container neck. Although the container disclosed in U.S. Pat. No. 6,076,704 has proven quite useful in applications where it is preferable to dispense the container contents through a nozzle, in instances where access to the container contents is gained with a drainage instrument such as a draining spike, additional sealing surfaces are often desirable.

The container disclosed in U.S. Pat. No. 6,092,682 to Weiler incorporates a closure insert subassembly including a nozzle and a separate spike cap which covers the nozzle and includes a membrane which provides a pierceable access to the container contents. Although the container disclosed in U.S. Pat. No. 6,092,682 has proven quite useful in applications where a syringe or the like is used to gain access to the container contents, there remains a need for a container where the pierceable membrane is unitary with the nozzle access port in the closure insert subassembly rather than with a cap or the like component separate from the insert and a draining spike can be sealingly received by the container.

SUMMARY OF THE INVENTION

A closure insert of the present invention for a hermetically sealed container provides improved sealing for a draining spike.

The closure insert comprises a hollow boss provided with a pierceable membrane and with an inwardly depending interior skirt portion that preferably terminates in a peripheral sealing band and also helps to stabilize a draining spike received within the container via an access port defined by the boss when the pierceable membrane has been penetrated by the draining spike. The pierceable membrane is recessed and is spaced from the sealing band which is adapted to surround a draining spike that penetrates the membrane.

Other advantages and features of the present invention will be more readily apparent from the following detailed description of the preferred embodiment of the invention, the accompanying drawings, and the appended claims.

BRIEF DESCRIPTION OF THE DRAWINGS

In the accompanying drawings forming part of the specification, in which like numerals are employed to designate like parts throughout the same, FIG. 1 is an enlarged broken perspective view of the top of a hermetically sealed container incorporating a closure insert according to the present invention;

FIG. 2 is an enlarged broken part vertical cross sectional view of the top of the container of FIG. 1 including the closure insert of the present invention;

FIG. 3 is an enlarged prospective view of the closure insert of the present invention;

DESCRIPTION OF THE PREFERRED EMBODIMENT

Figure 4:
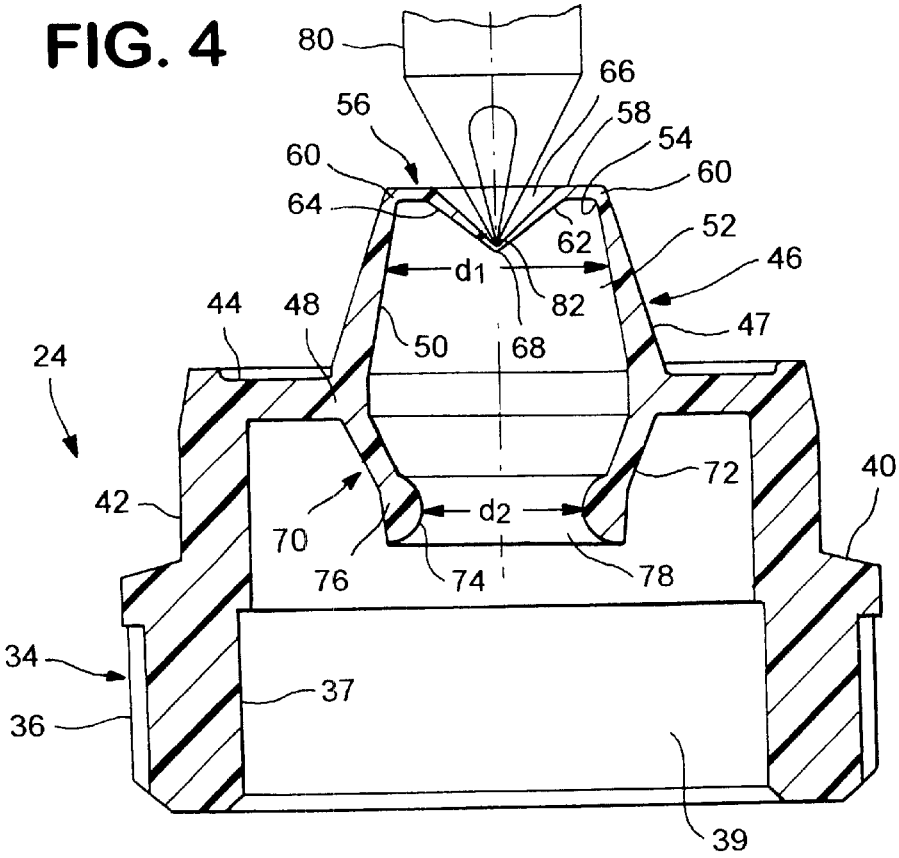
FIG. 4 is an enlarged vertical cross-sectional view of the closure insert of FIG. 3 with a draining spike in piercing position.

The invention disclosed herein is, of course, susceptible of embodiment in many different forms. Shown in the drawings and described below in detail is a preferred embodiment of the invention. It is to be understood, however, that the present disclosure is an exemplification of the principles of the invention and does not limit the invention to the illustrated embodiment.

For ease of description, the container and closure insert of the present invention will be described in a normal (upright) operating position and terms such as upper, lower, horizontal, etc., will be used with reference to this position. It will be understood, however, that the container and closure insert of the present invention may be manufactured, stored, transported, used, and sold in an orientation other than the position described.

A formed, filled, and hermetically sealed, thermoplastic container 10 of the present invention is illustrated in FIGS. 1 and 2. Container 10, of which only the top portion is shown in FIGS. 1 and 2, is preferably fabricated from conventional molding materials such as polyethylene (low or high density), polypropylene, and the like materials compatible with the contemplated container contents. The overall shape of the container is not critical.

The top portion 16 of the container 10 terminates in a neck 18 unitary therewith which includes a generally cylindrical throat 20 that, in turn, defines a hollow passageway for dispensing container contents.

The throat 20, in turn, terminates in a socket 22 unitary therewith which receives a closure insert 24 as shown in FIG. 2. Closure shroud 26, delineated from the socket 22 by a frangible web 28, covers closure insert 24. Closure shroud 26 optionally includes two spaced apart unitary and diametrically opposed wings 30 and 32. Closure shroud can be transparent, translucent, or opaque, as desired.

Referring to FIGS. 2 and 3, closure insert 24 includes a hollow generally cylindrical base 34 including an outer peripheral surface 36 provided with a scabrous outer perimeter band into which is molded the thermoplastic material from which the container 10 as well as the socket 22 are fabricated. As described and claimed in U.S. Pat. No. 6,092,682 to Weiler, the thermoplastic material forming the container socket 22 substantially fills the channels defined by the scabrous band to immobilize the closure insert 24 and form a permanent seal between the closure insert 24 and the socket 22 when the closure insert 24 is fixed therein. The base 34 also includes an interior surface 37 defining an interior cavity 39.

Closure insert 24 is also provided with a shoulder portion 40 which tapers unitarily upwardly inwardly from the upper peripheral edge of the base 34. The shoulder 40 merges into a cylindrical web portion 42 which extends unitarily generally vertically upwardly from the upper peripheral edge of the shoulder 40.

Figure 5:
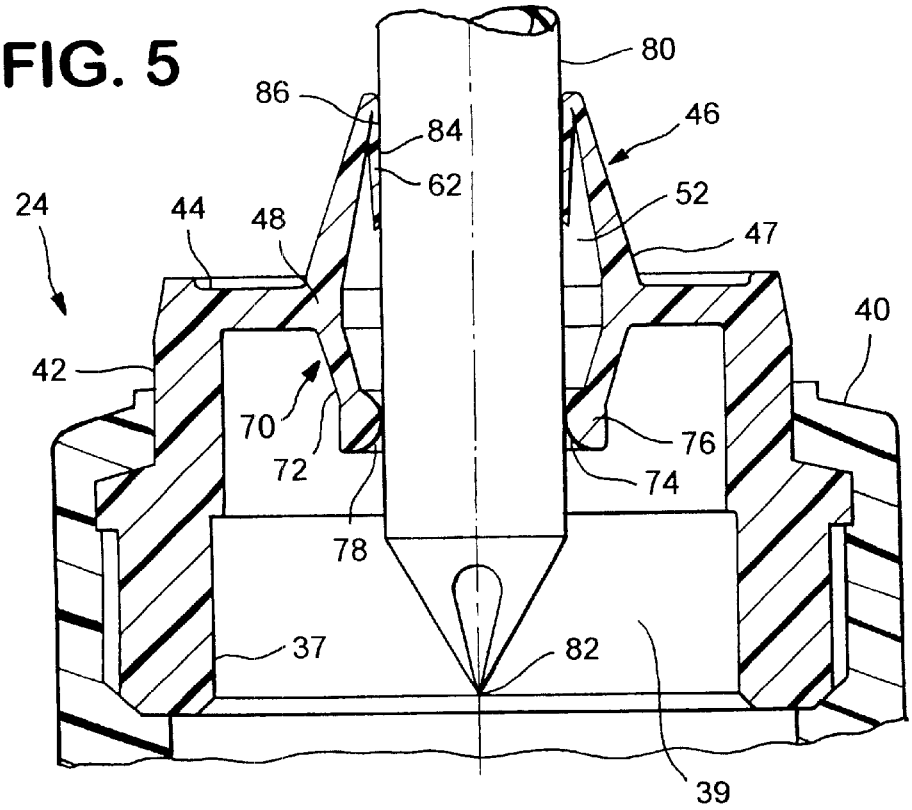
FIG. 5 is an enlarged vertical cross-sectional view which depicts a draining spike after piercing the membrane and stabilization within the container.

The closure insert 24 includes a flat top wall 44 which extends radially and generally inwardly from the upper peripheral edge of the web portion 42, and terminates in a boss 46 which is unitary with the top wall 44. As best seen in FIGS. 4 and 5, the hollow boss 46 includes a frustroconically shaped and circumferentially extending wall 47 which tapers inwardly and upwardly from the inner peripheral circumferential edge 48 of the wall 44 and includes an interior surface 50 defining a passageway or hollow interior 52 which is in fluid flow communication with the cavity 39 defined by the base 34 which, in turn, is in fluid flow communication with the container throat 20 and, in turn, the interior of the container 10.

A recessed pierceable membrane 56, unitary with boss 46, occludes access to hollow interior 52. Pierceable membrane 56 is made of thermoplastic material having a pierceable, non-coring thickness which is less than the thickness of the thermoplastic material which forms the remainder of the boss 46 and the closure insert 22.

More particularly, the membrane 56 includes a first wall portion 58 which extends radially inwardly from the top peripheral edge 60 of the port wall 47. The membrane 56 also includes a conically shaped second wall portion 62 which tapers inwardly and downwardly from the inner peripheral edge 64 of the first membrane wall portion 58 and defines a cone-shaped depression, socket or concavity 66 which terminates in a point 68 which is aligned with the longitudinal axis of the container 10.

Referring to FIG. 4, the closure insert 24 additionally includes an interior skirt portion or hollow, open-ended tube 70 comprising an annular circumferential wall 72 extending and tapering inwardly from the inner peripheral edge 48 of the wall 44 into the cavity 39 defined in the interior of the base 34. A sealing band, such as bead or rib 74, is situated at the distal end portion of the skirt 70 and preferably protrudes from and extends circumferentially radially inwardly from a lower peripheral edge portion 76 of the skirt 70. The distal end portion of skirt 70 defines a lower skirt opening 78 in open communication with the base cavity 39. The sealing band is spaced from membrane 56, preferably by a distance equal to at least one outside diameter of a draining spike. Preferably the recessed membrane 56 and the access opening 54 have a diameter $d_1$ which is greater than the diameter $d_2$ of the lower skirt opening 78.

The closure insert 24 and, more particularly, the hollow boss 46 thereof, is adapted to receive a draining spike 80 or the like piercing instrument as also shown in FIGS. 4 and 5.

FIG. 4 depicts the position of the draining spike 80 wherein the tip 82 thereof is located within the interior of the membrane concavity 66 and about to pierce the membrane. The shape of the wall portion 62 of the membrane 56 substantially complements the shape of the spike tip 82 and thus provides and acts as a guide for the tip 82 into a position where the spike tip 82 is positioned directly above and in an abutting relationship with the outer surface of the point 68 of the membrane wall portion 62.

Once the spike 80 has been so positioned as shown in FIG. 4, the spike is urged downwardly so as to cause the spike tip 82 to penetrate or fracture the membrane wall 62 at the point 68 thereof. Once the membrane 56 has been fractured, the spike point 82 is pushed inwardly further through the passageway 52 defined by the port 46, then through the interior of the tube which defines the skirt 70, and into the cavity 39 defined in the interior of the base 34 into the position of FIG. 5. At this stage, tip 82 of piercing spike 80 is appropriately positioned to allow the removal of the container contents, and the draining spike 80 is stabilized. This distal end portion of skirt 70 together with a sealing band, such as rib or bead 74, provide a primary seal around the draining spike, and the wall 62 of fractured membrane 56 provides a secondary seal for draining spike 80.

As also shown in FIG. 5, the exterior surface 84 of the membrane wall 62 is adapted to abut against the outer surface 86 of the spike 80. Also, in accordance with the present invention, the wall 47 of the boss 46 preferably is adapted and structured to flex outwardly as the draining spike is received therein. This, in turn, causes the membrane wall 62 to exert a compressive force against the outer surface 86 of the spike 80 thus providing a seal between the boss 46 and the draining spike 80 which helps to minimize any leakage of the container contents.

As also shown in FIG. 5, the sealing bead or rib 74 of the skirt 70 is adapted to abut against the lower portion of the outer surface 86 of the spike 80 to provide a primary seal between the closure insert 24 and the spike 80 and thus minimizes any leakage of the container contents between the boss 46 and the spike 80. The seal formed around the spike by the pierced membrane serves as a secondary seal, as stated hereinabove. As shown in FIGS. 4 and 5, the diameter of the skirt 70 at the opening 78 thereof preferably is less than the diameter of the spike 80 so as to cause the skirt wall 72 to flex outwardly from the position of FIG. 4 to the position of FIG. 5 when the spike 80 is advanced therethrough. The flexure, in turn, causes the skirt 70, and thus the rib 74 thereof to exert an inward compressive force against the outer surface 86 of the spike 80 so as to provide a tight seal between the skirt 70 and the spike 80.

The closure insert contemplated by the present invention is prefabricated, for example, by injection molding, and can have a wide variety of dispensing configurations depending upon contemplated end use. Single piece inserts as well as subassemblies are contemplated. However, in all instances, the closure insert is provided with a boss including a recessed pierceable membrane.

I claim:

1. A closure insert for a hermetically sealed container and comprising a hollow base including an interior surface defining an interior cavity, a top wall extending radially inwardly from said base, a hollow boss extending upwardly from an interior edge of said top wall and provided with a recessed, pierceable membrane, and an inwardly depending interior skirt portion extending downwardly from said wall into said interior cavity and spaced from said interior surface along the entire length thereof and that terminates in a peripheral distal sealing band; said pierceable membrane being spaced from said sealing band, and said sealing band being adapted to sealingly surround a draining spike that penetrates the membrane.

2. The closure insert of claim 1 wherein the pierceable membrane defines a cone-shaped socket.

3. The closure insert of claim 2 wherein the membrane defining the socket surrounds a draining spike when pierced.

4. The closure insert of claim 1 wherein the membrane is made of a thermoplastic material and is unitary with the closure insert.

5. The closure insert of claim 1 wherein the interior skirt portion is adapted to flex outwardly toward said interior surface of said base while remaining in an abutting relationship with a draining spike that pierces the membrane.

6. The closure insert of claim 1 wherein both the membrane and the skirt portion have a diameter and the diameter of the membrane is less than the diameter of the skirt portion.

7. The closure insert of claim 1 wherein the sealing band is a sealing bead that extends radially inwardly from the skirt portion.

8. A closure insert for a hermetically sealed container and comprising a hollow base including an interior surface defining an interior cavity, a top wall extending radially inwardly from said base, a hollow boss provided with a recessed, pierceable membrane and an inwardly depending interior skirt portion extending downwardly from said top wall into said interior cavity and spaced from said interior surface along hejentire length thereof and terminating in a peripheral distal sealingbead which is adapted to sealingly surround a draining spike that penetrates the membrane; said interior skirt portion being adapted to flex outwardly toward said interior surface of said base while remaining in an abutting relationship with a draining spike thatpierces the membrane.

9. A hermetically sealed container provided with a closure insert that seals access to the container and comprises a hollow base including an interior surface defining an interior cavity, a top wall extending radially inwardly from said base, a hollow boss provided with a recessed, pierceable membrane and with an inwardly depending interior skirt portion 7 extending downwardly from said top wall into said interior cavity and spaced from said interior surface along the entire length thereof and terminating in a peripheral sealing band;

said pierceable membrane being spaced from said sealing portion, and said sealing band being adapted to sealingly surround a draining spike that penetrates the membrane.

10. The container of claim 9 wherein the sealing band is a sealing bead that extends radially inwardly from the skirt portion.

* * * * *

UNITED STATES PATENT AND TRADEMARK OFFICE

CERTIFICATE OF CORRECTION

PATENT NO. : 6,571,971 B1
DATED : June 3, 2003
INVENTOR(S) : Gerhard H. Weiler

It is certified that error appears in the above-identified patent and that said Letters Patent is hereby corrected as shown below:

Column 5,
Line 15, “hejentire” should be -- the entire --.
Line 20, “thatpierces” should be -- that pierces --.

Column 6,
Line 7, delete “7”.
Lines 10-11, “sealing portion,” should be -- peripheral sealing band, --.

Signed and Sealed this

Twenty-third Day of December, 2003

JAMES E. ROGAN
*Director of the United States Patent and Trademark Office*